US010889929B1

(12) United States Patent
Baker et al.

(10) Patent No.: US 10,889,929 B1
(45) Date of Patent: Jan. 12, 2021

(54) ADAPTIVE APPARATUS FOR TRANSPORTING AND SEWING MATERIAL ALONG ARBITRARY SEAM SHAPES

(71) Applicant: SoftWear Automation Inc., Cumming, GA (US)

(72) Inventors: Michael Baker, Acworth, GA (US); Wael Saab, Atlanta, GA (US)

(73) Assignee: SoftWear Automation, Inc., Cumming, GA (US)

( * ) Notice: Subject to any disclaimer, the term of this patent is extended or adjusted under 35 U.S.C. 154(b) by 0 days.

(21) Appl. No.: 16/918,803

(22) Filed: Jul. 1, 2020

(51) Int. Cl.
*D05B 21/00* (2006.01)
*D05B 35/02* (2006.01)

(52) U.S. Cl.
CPC ..... *D05B 21/00* (2013.01); *D05B 35/02* (2013.01)

(58) Field of Classification Search
CPC ..... D05B 21/00; D05B 35/02; D05B 35/04; D05B 3/00; D05B 3/10; D05B 3/24; D05B 27/00; D05B 27/10–16; D05B 29/00; D05B 29/10; D05B 31/00; D05B 39/00; B43L 13/20
See application file for complete search history.

(56) References Cited

U.S. PATENT DOCUMENTS 3,322,081 A * 5/1967 Winberg ..... D05B 35/105 112/470.09
3,654,817 A * 4/1972 Kane ..... B05B 3/0454 74/568 R
3,670,528 A * 6/1972 Fregeolle ..... D04B 35/34 66/147
3,828,703 A * 8/1974 Sugland ..... D05B 39/00 112/470.09
4,109,595 A * 8/1978 Ducol ..... D05B 35/102 112/136
4,444,133 A * 4/1984 Bolldorf ..... D05C 5/00 112/103
4,493,276 A * 1/1985 Sadeh ..... D05B 93/00 112/470.07
4,813,364 A * 3/1989 Boser ..... D05B 27/12 112/153
4,899,675 A * 2/1990 Kawasaki ..... B23Q 1/4804 112/153

(Continued)

*Primary Examiner* — Ismael Izaguirre
(74) *Attorney, Agent, or Firm* — Thomas | Horstemeyer, LLP

(57) ABSTRACT

Various examples are provided related to transporting and sewing material in, e.g., automation of sewing robots. Multiple pieces of layered materials can be transported on a flat planar surface while maintaining the material layer's position and orientation relative to one another during a sewing procedure of these materials along any arbitrary seam shape. In one example, among others, a system includes a sewing machine including a sewing needle, a material holding assembly and a translation system. The material holding assembly can include mechanical fingers that can contact material on a sewing plane adjacent to the sewing needle and a structural grounding system supporting the mechanical fingers. The translation system can reposition the material on the sewing plane via the mechanical fingers. Clearance around the sewing needle can be provided by repositioning individual mechanical fingers around the sewing needle.

20 Claims, 13 Drawing Sheets

(56) References Cited

U.S. PATENT DOCUMENTS

| | | | | |
|---|---|---|---|---|
| 5,226,378 | A * | 7/1993 | Suzuki | D05B 35/102 112/470.02 |
| 2011/0315059 | A1 * | 12/2011 | Lee | D05C 9/04 112/103 |

* cited by examiner

ADAPTIVE APPARATUS FOR TRANSPORTING AND SEWING MATERIAL ALONG ARBITRARY SEAM SHAPES

CROSS-REFERENCE TO RELATED APPLICATIONS

This application is related to U.S. application entitled "PALLETLESS SEWING METHODS AND SYSTEMS" having Ser. No. 16/918,875, filed Jul. 1, 2020, which is hereby incorporated by reference in its entirety.

BACKGROUND

Often in the production of sewn products, stitches must be sewn with a high degree of accuracy onto one or more flat pieces of material. These stitches may be decorative, structural, or both, and may not follow features of the materials themselves. Because of the above mentioned nature of these seams, human operators are not well suited to the task, and instead a pattern sewing machine is often used.

Pattern sewing machines utilize custom made templates to clamp onto layers of materials prior to initiating the sewing procedure. These templates are then loaded onto a pattern sewing machine. The pattern sewing machine will move these templates with clamped layers of materials to the sewing needle. The pattern sewing machine will then follow a predefined path and sew seam lines within the manufactured open shapes of the template (at high speeds). Often more complicated products will require several of these templates for each size, style, and manufacturing step, reducing manufacturing flexibility and increasing tooling cost.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology.

BRIEF DESCRIPTION OF THE DRAWINGS

The accompanying drawings illustrate various examples of systems, methods, and embodiments of various other aspects of the disclosure. Any person with ordinary skills in the art will appreciate that the illustrated element boundaries (e.g., boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles. Moreover, in the drawings, like reference numerals designate corresponding parts throughout the several views.

DETAILED DESCRIPTION

Figure 1:
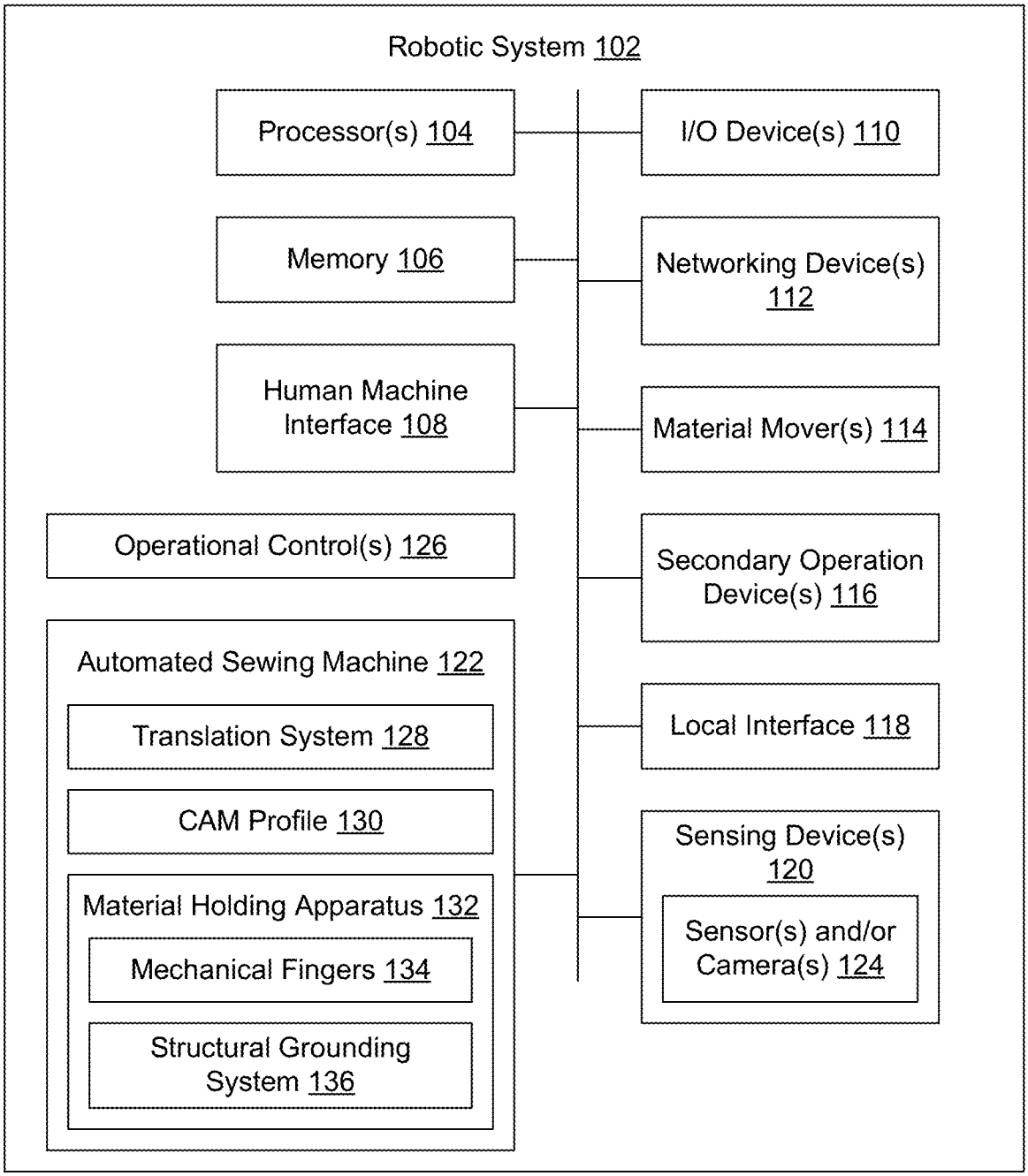
FIG. 1 illustrates an example of a robotic system, according to various embodiments of the present disclosure.

Disclosed herein are various examples related to transporting and sewing material along arbitrary seam shapes in, e.g., the automated production of sewn products. The present disclosure is generally related to an apparatus capable of securing the orientation and position of layered materials in order to be sewn with an automated sewing machine. For example, an adaptive apparatus can enable sewing multiple material layers of various designs and sizes since it can adapt to arbitrary seam shapes. The adaptive apparatus can clamp down on layered materials and prevent them from puckering, slipping or shifting their relative positions and orientations during a sewing operation. Reference will now be made in detail to the description of the embodiments as illustrated in the drawings, wherein like reference numbers indicate like parts throughout the several views.

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present disclosure, the preferred systems and methods are now described.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Referring to FIG. 1, shown is an example of a system that can be used for material manipulation and sewing. As illustrated in the example of FIG. 1, the system can comprise a robotic system 102, which can include a processor 104, memory 106, an interface such as, e.g., a human machine interface (HMI) 108, I/O device(s) 110, networking device(s) 112, material mover(s) 114, secondary operation device(s) 116, a local interface 118, sensing device(s) 120, and an automated sewing machine 122. The sensing device(s) 120 can comprise one or more sensor and/or camera 124. The robotic system 102 can also include operational control(s) 126, which can be executed by the robotic system 102 to implement manipulation and/or processing of materials. The automated sewing machine 122 can comprise, e.g., a translation system 128, a cam profile 130, material holding apparatus 132, mechanical fingers 134 and a structural grounding system 136. The automated sewing machine 122 also includes a sewing machine with at least one sewing needle at the sewing head as will be discussed.

The processor 104 can be configured to decode and execute any instructions received from one or more other electronic devices or servers. The processor can include one or more general-purpose processors (e.g., INTEL® or Advanced Micro Devices® (AMD) microprocessors) and/or one or more special purpose processors (e.g., digital signal processors or Xilinx® System on Chip (SOC) field programmable gate array (FPGA) processor). The processor 104 may be configured to execute one or more computer-readable program instructions, such as program instructions to carry out any of the functions described in this description.

The Memory 106 can include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions. The Memory 106 can comprise one or more modules (e.g., operational control(s) 126) that can be implemented as a program executable by processor(s) 104.

The interface(s) or HMI 108 can accept inputs from users, provide outputs to the users or may perform both the actions. In one case, a user can interact with the interface(s) using one or more user-interactive objects and devices. The user-interactive objects and devices may comprise user input buttons, switches, knobs, levers, keys, trackballs, touchpads, cameras, microphones, motion sensors, heat sensors, inertial sensors, touch sensors, visual indications (e.g., indicator lights or meters), audio indications (e.g., bells, buzzers, etc.) or a combination of the above. Further, the interface(s) can either be implemented as a command line interface (CLI), a graphical user interface (GUI), a voice interface, or a web-based user-interface, at element 108. The interface(s) can also include combinations of physical and/or electronic interfaces, which can be designed based upon the environmental setting or application.

The input/output devices or I/O devices 110 of the robotic system 102 can comprise components used to facilitate connections of the processor 104 to other devices such as, e.g., material mover(s) 114, secondary operation device(s) 116, sensing device(s) 120 and/or the automated sewing machine 122 and can comprise one or more serial, parallel, small system interface (SCSI), universal serial bus (USB), IEEE 1394 (i.e. Firewire™) connection elements or other appropriate connection elements.

The networking device(s) 112 of the robotic system 102 can comprise the various components used to transmit and/or receive data over a network. The networking device(s) 112 can include a device that can communicate both inputs and outputs, for instance, a modulator/demodulator (i.e. modem), a radio frequency (RF) or infrared (IR) transceiver, a telephonic interface, a bridge, a router, as well as a network card, etc.

The material mover(s) 114 of the robotic system 102 can facilitate material manipulation between operations. The material mover(s) 114 can move, stack, or position the materials prior to the next operation. In some embodiments, the material mover(s) 114 may transport materials into a predetermined alignment prior to a sewing or other operation.

In some embodiments, the material mover(s) 114 can comprise a manipulator capable of spatial motions and one or more material handling components. These material handling components, depending on the material being handled, can utilize various gripping technologies such as, e.g., air flow, vacuum, mechanical gripping, such as a clamp, pinching, pins, or needles, electro-adhesion, adhesion, electrostatic forces, freezing, brush, or hook and loop, etc. In various embodiments, the material mover(s) 114 can comprise end effector(s) which can be manipulated through one or more manipulator(s) such as, e.g., industrial robot(s) or other manipulator or appropriate manipulation assembly. Industrial robots include, e.g., articulated robots, selective compliance assembly robots (SCARA), delta robots, and cartesian coordinate robots (e.g., gantry robots or x-y-z robots). Industrial robots can be programmed to carry out repetitive actions with a high degree of accuracy or can exhibit more flexibility by utilizing, e.g., machine vision and machine learning. For example, a material mover can be moved to engage with the material and manipulate its position and/or orientation for processing by the robotic system 102. When the desired processing of the material is complete, movement of the material mover 114 can transport the material out of the work area. This automated motion can be very beneficial in many repetitive processes. The secondary operation device(s) 116 can include destacking device(s), stacking device(s), folding device(s), label manipulation device(s), and/or other device(s) that assist with the preparation, making and/or finishing of the sewn product.

The local interface 118 of the robotic system 102 can be, for example, but not limited to, one or more buses or other wired or wireless connections, as is known in the art. The local interface 118 can have additional elements, which are omitted for simplicity, such as controllers, buffers (caches), drivers, repeaters, and receivers, to enable communications. Further, the local interface 118 can include address, control, and/or data connections to enable appropriate communications among the components, at element 122.

The sensing device(s) 120 of the robotic system 102 can facilitate detecting the movement of the product material(s) and inspecting the product material(s) for defects and/or discrepancies before, during or after a sewing and cutting operation or other process operation. Further, the sensing device(s) 120 can facilitate detecting markings on the product before cutting or sewing the material. A sensing device 120 can comprise, but is not limited to, one or more sensor and/or camera 124 such as, e.g., an RGB camera, an RGB-D camera, a near infrared (NIR) camera, stereoscopic camera, photometric stereo camera (single camera with multiple illumination options), time of flight camera, Internet protocol (IP) camera, light-field camera, monorail camera, multiplane camera, rapatronic camera, stereo camera, still camera, thermal imaging camera, acoustic camera, rangefinder camera, etc., at element 120. The RGB-D camera is a digital camera that can provide color (RGB) and depth information for pixels in an image. The sensing device(s) 120 can also include one or more motion sensor(s), temperature sensor(s), humidity sensor(s), microphone(s), ultrasound device(s), radar or lidar device(s), RF receiver(s) and/or other environmental or electronic sensor(s).

An automated sewing machine 122 is a sewing system that can include a computerized sewing machine, a material securing assembly to secure one or more layers of material, and computer-controlled actuators that can move the material securing assembly relative to the sewing machine to facilitate the sewing of the secured material(s). The translation system 128 can include elements responsible for the relative motion between the material securing assembly and the sewing machine of the automated sewing machine 122. In one embodiment, this motion could be achieved with an XYZ cartesian motion system (e.g., cartesian coordinate robots, gantry robots or x-y-z robots), where the XY motion is planar and on a sewing plane (or worksurface) 209, and the Z motion lifts or drops the material securing assembly onto the material(s). In another embodiment, the translation system 128 can use a polar motion system. In yet another embodiment, the translation system 128 can be any of a number of styles of industrial robot.

The material securing assembly of the automated sewing machine 122 can include a material holding apparatus 132 that can adapt during operation of the automated sewing machine 122. The material holding apparatus 132 is capable of changing its contact points on the material(s) during the sewing process to allow the sewing machine access to most or all of the surface of the material. Mechanical fingers 134 attached to the structural grounding system 136 can clamp onto multiple layers of material which can adapt to different styles and sizes and sew arbitrarily shaped seam lines at high speeds. A cam profile 130 can be a body fixed in space (e.g., to the sewing machine 203), allowing followers of the mechanical fingers 134 to move on the cam profile to produce finger displacement. The shape of the cam profile 130 can be designed to produce a desired motion of the followers and thus the mechanical fingers 134 e.g. to avoid contact with the sewing needle. The structural grounding system 136 can be configured to support and allow movement of the mechanical fingers 134 to maintain uniform contact of the belt with the layered material, e.g., during finger translation, and therefore preserve their relative position and orientation. The displacement of the mechanical fingers 134 can provide space around the sewing needle to allow the sewing machine to produce a stitch that can hold the layered material together.

As shown in FIG. 1, the robotic system 102 includes operational control(s) 126 which can control the robotic system 102, as will be discussed. The operational control(s) 126 can include one or more process modules that can be executed in order to control operation of various components of the robotic system 102 such as the automated sewing machine 122.

Functioning of the material securing assembly will now be discussed with reference to FIGS. 2A-2F. One skilled in the art will appreciate that, for this and other processes and methods disclosed herein, the functions performed in the processes and methods may be implemented in differing order. Furthermore, the outlined steps and operations are provided as examples, and some of the steps and operations may be optional, combined into fewer steps and operations, or expanded into additional steps and operations without detracting from the essence of the disclosed embodiments.

Figure 2A:
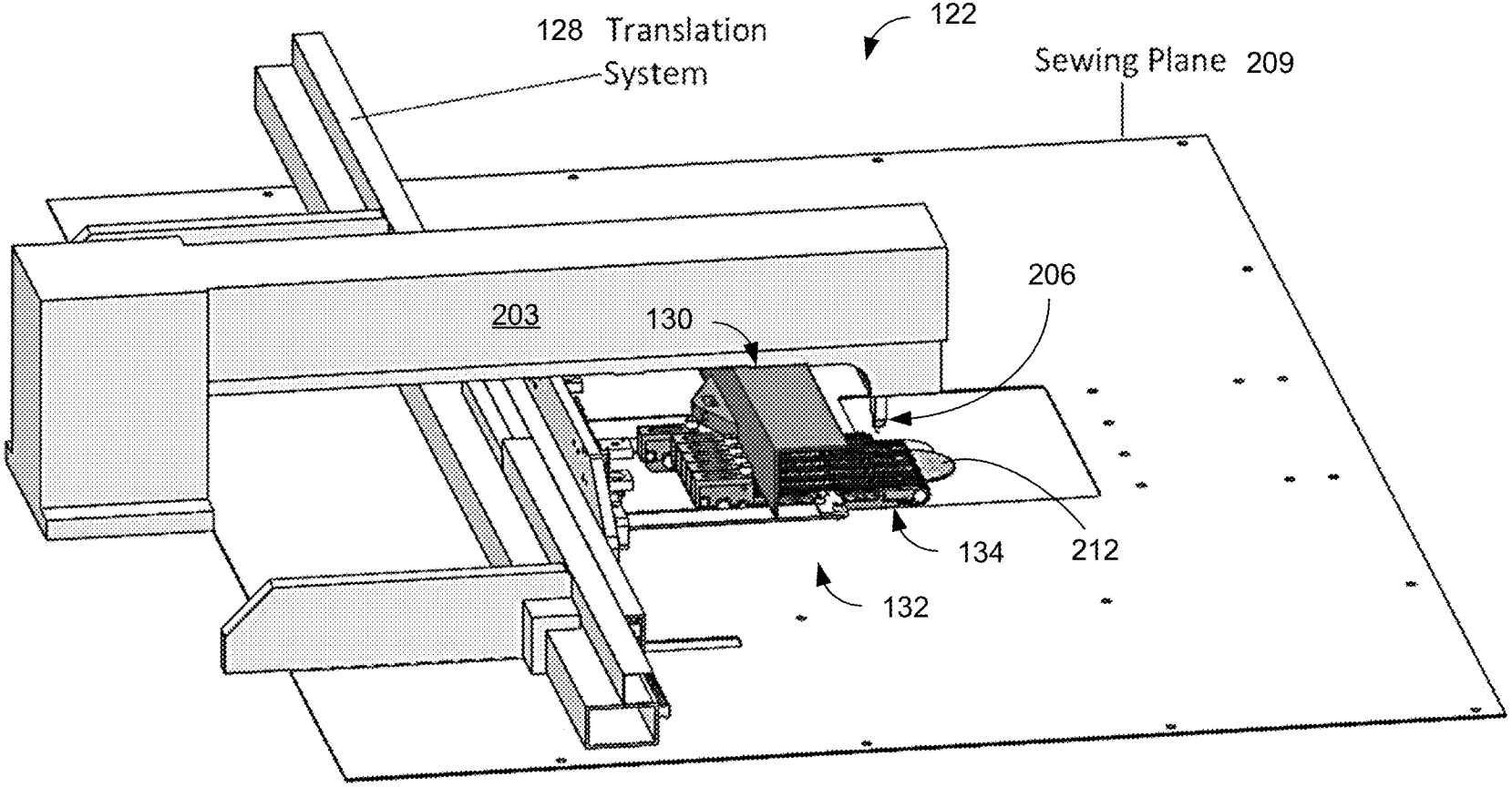
FIGS. 2A-2G illustrate an example of the robotic system comprising a translational system and material holding apparatus, according to various embodiments of the present disclosure.

Referring to FIG. 2A, shown is an example of a translation system 128 and material securing assembly of the automated sewing machine 122. The automated sewing machine 122 can comprise a sewing machine 203 with a sewing needle 206 (e.g., a computerized JUKI® sewing machine), the translation system 128 and the material holding apparatus 132 with the mechanical fingers 134 over a sewing plane 209. The sewing plane 209 is the work area in which a material can be sewn utilizing a single array or multiple arrays of mechanical fingers 134 of the material holding apparatus 132, that can translate relative to material pieces 212 being sewn without the unsewn material pieces altering their relative position and orientation. For example, two arrays of mechanical fingers 134 can be positioned opposite (or facing) each other to facilitate sewing of the material pieces 212. The translation system 128 which can produce XYZ motion in which the XY motion is planar motion on the sewing plane 209 and the Z motion is up and down motion. The translation system 128 is attached to the material holding apparatus 132 allowing it to move in an XY motion. The linear array of mechanical fingers 134 acts as a means of transporting layers of material on a planar surface of the sewing plane 209 without altering their relative position and orientation.

Figure 2B:
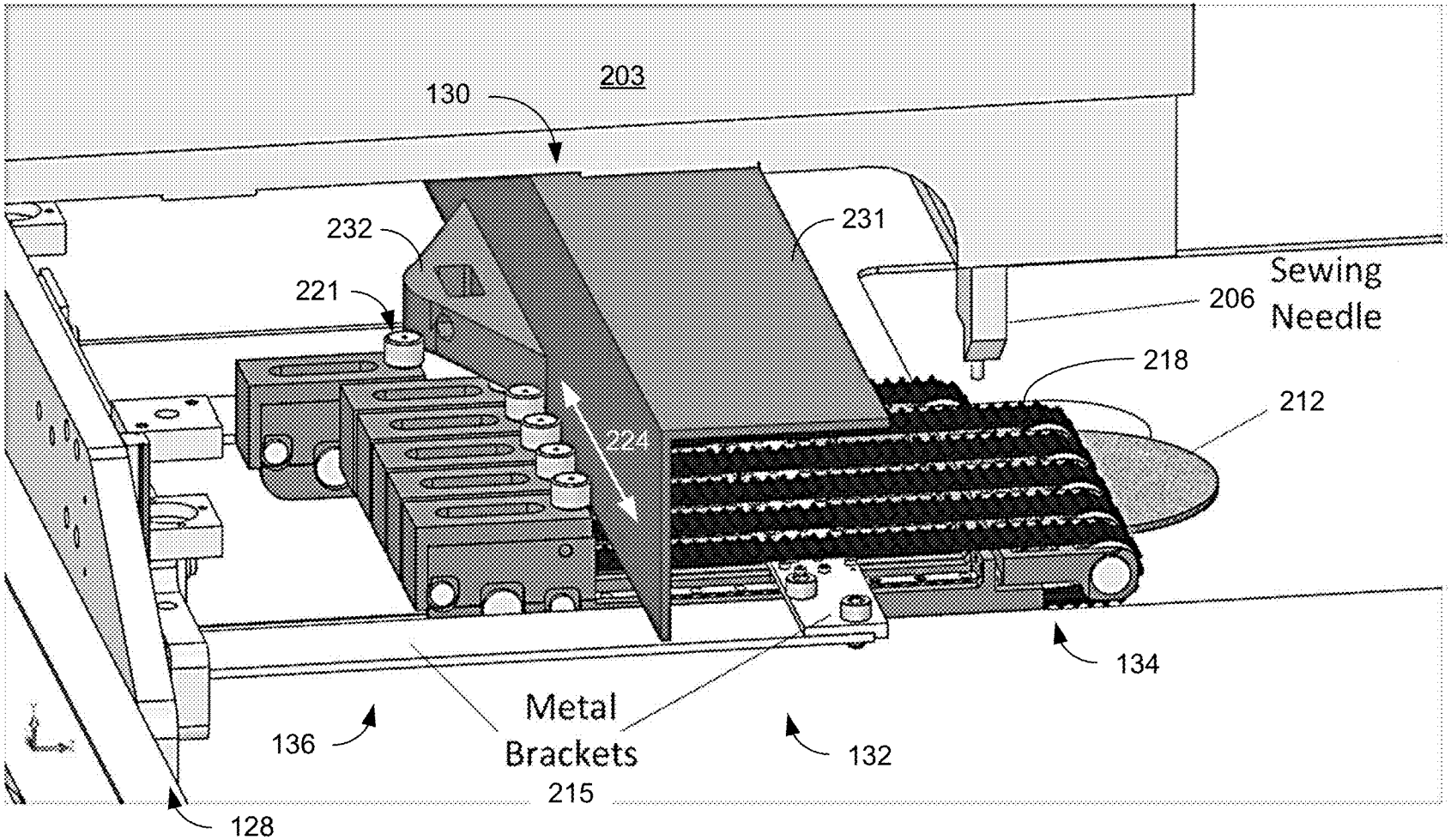

Referring to FIG. 2B, shown is an expanded view of the material securing assembly including the array of mechanical fingers 134 supported by the structural grounding system 136 attached to the translation system 128. The structural grounding system 136 can include a support frame comprising metal brackets 215 attached to the translation system 128 and extending through the mechanical fingers 134. The mechanical fingers 134 include a belt 218 configured to contact with the layered material 212 to preserve their relative position and orientation. In the example of FIG. 2B, a belt 218 is used, however it can be any contact element which enables continuous rotation around two rotational axes such as, e.g., a chain, material strip, rubber strip, timing belt, etc. Motion (linear displacement) of the mechanical fingers 134 can be achieved by first transporting the layered material 212 to the sewing needle 206 in the XY plane using the translation system 128. Then followers 221 of the mechanical fingers can engage with the cam profile 130 which causes finger displacement. As seen in FIG. 2B, the cam profile 130 can comprise a surface along which the followers 221 travel as the material holding apparatus 132 is repositioned with respect to the sewing needle 206. The surface can include flat (or linear) portions and one or more projecting portion(s) that extends away from the flat portion. In the illustrated example, the flat portions are provided by a mounting bracket 231 (e.g., an L-shaped metal bar) and the projecting portion can be provided by a tapered cam 232 affixed to the bracket 231, or integrated as part of the mounting bracket 231. As the mechanical fingers 134 are repositioned sideways along the bracket 231 (see arrow 224), the follower 221 moves across the flat portion, and the corresponding mechanical finger 134 remains extended in the same position. As the follower 221 moves across the projecting portion, the corresponding mechanical finger 134 is pulled back away from the sewing needle 206. The cam 232 can be shaped to provide sufficient clearance between the fingers and the sewing needle or other system components, as needed. The cam profile 130 can be reconfigured by adding or removing cams 232 attached to the bracket 231, or by utilizing cams 232 with different shapes and taper designs.

As can be seen, the sewing needle 206 extends toward the layered materials adjacent to the mechanical fingers 134. The material holding apparatus 132 is attached to the translation system 128 allowing the mechanical fingers 134 to be moved using the movement of the translation system 128. The sewing needle 206 sews the layered materials 212 together without interference from the mechanical fingers 134. The linear array of mechanical fingers 134 acts as a means of transporting layers of material 212 on the planar surface of the sewing plane 209 without altering their relative position and orientation. This can also be achieved using a belt grounding mechanism that rigidly connects a belt of the mechanical finger 134 to the translation system 128 via the metal bracket 215, yet allowing the mechanical finger 134 to translate onto and off of the material because of the cam profile engagement.

The translation of the mechanical fingers 134 can use a passive belt drive system that allows the belt 218 to rotate about the finger and does not alter the layered material 212 relative position or orientation. The mechanical fingers 134 can be displaced linearly in order to provide the clearance around the sewing needle 206 to sew stitches. In some embodiments, a clearance may be created for other operations to be performed on the material(s) 212 such as, e.g., vision inspection, hole punching, or laser etching. The structural grounding system 136 can utilize a cam-follower combination to passively displace the mechanical fingers 134 linearly to create clearance around the sewing needle 206. This feature may also be accomplished using, e.g., motors or other appropriate mechanism in each mechanical finger 134 to produce linear displacement of each mechanical finger 134.

Figure 2C:
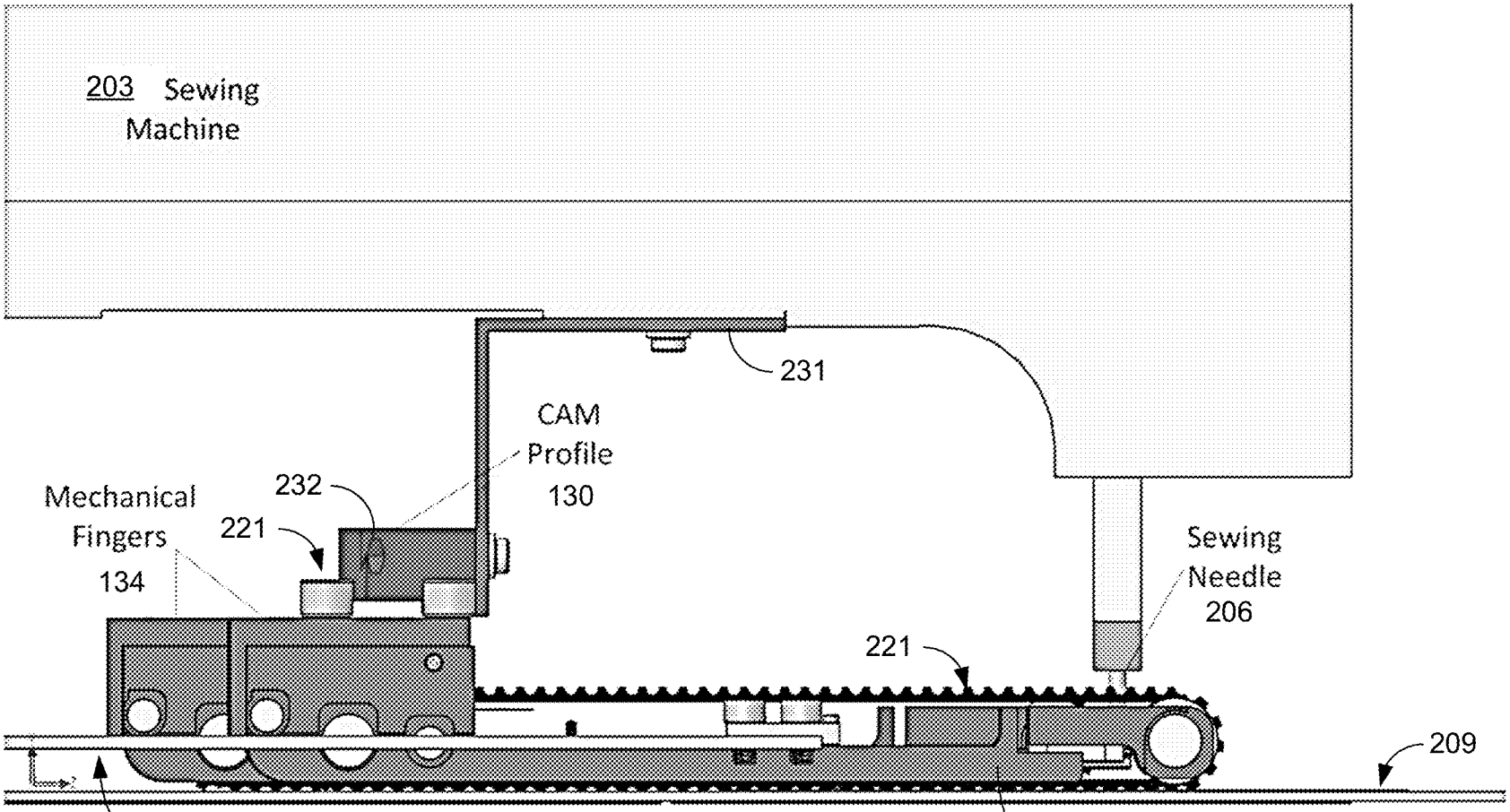

Referring now to FIG. 2C, shown is a side view illustrating the relationship between the cam profile 130, the mechanical fingers 134 of the material holding apparatus 132, and the sewing needle 206. The cam profile 130 can be fixed in position with respect to the sewing needle 206 by, e.g., attaching the mounting bracket 231 to the sewing machine 203. As a follower moves along the surface of the cam profile 130, the mechanical finger 134 to which it is attached can be linearly displaced away from the sewing needle 206. As can be seen in FIG. 2C, the mounting bracket 231 of the cam profile 130 can be attached to the sewing machine 203 by a bolt, screw, fastener or other appropriate fastening technique (e.g., welding, adhesives, etc.). The mounting bracket 231 can be detachably attached to allow for the cam profile 130 to be replaceable. The tapered cam 232 can be attached to the mounting bracket 231 by a bolt, screw, or other appropriate fastening technique. In some embodiments, the cam 232 can be an integral part of the mounting bracket 231.

As shown in FIG. 2C, a mechanical finger 134 is retracted with respect to the other mechanical fingers 134 as the follower 221 moves across the projection of the cam profile 130. This passive cam-follower system can cause the mechanical fingers 134 to displace linearly in order to provide the clearance around the sewing needle to sew stitches. This passive system can displace specific mechanical fingers 134 as needed to create clearance around the sewing needle 206, and then allow them to return to their original position after passing by the sewing needle 206. In some embodiments, this movement may be accomplished by using motors in each mechanical finger 134 to produce the linear displacement.

Figure 2D:
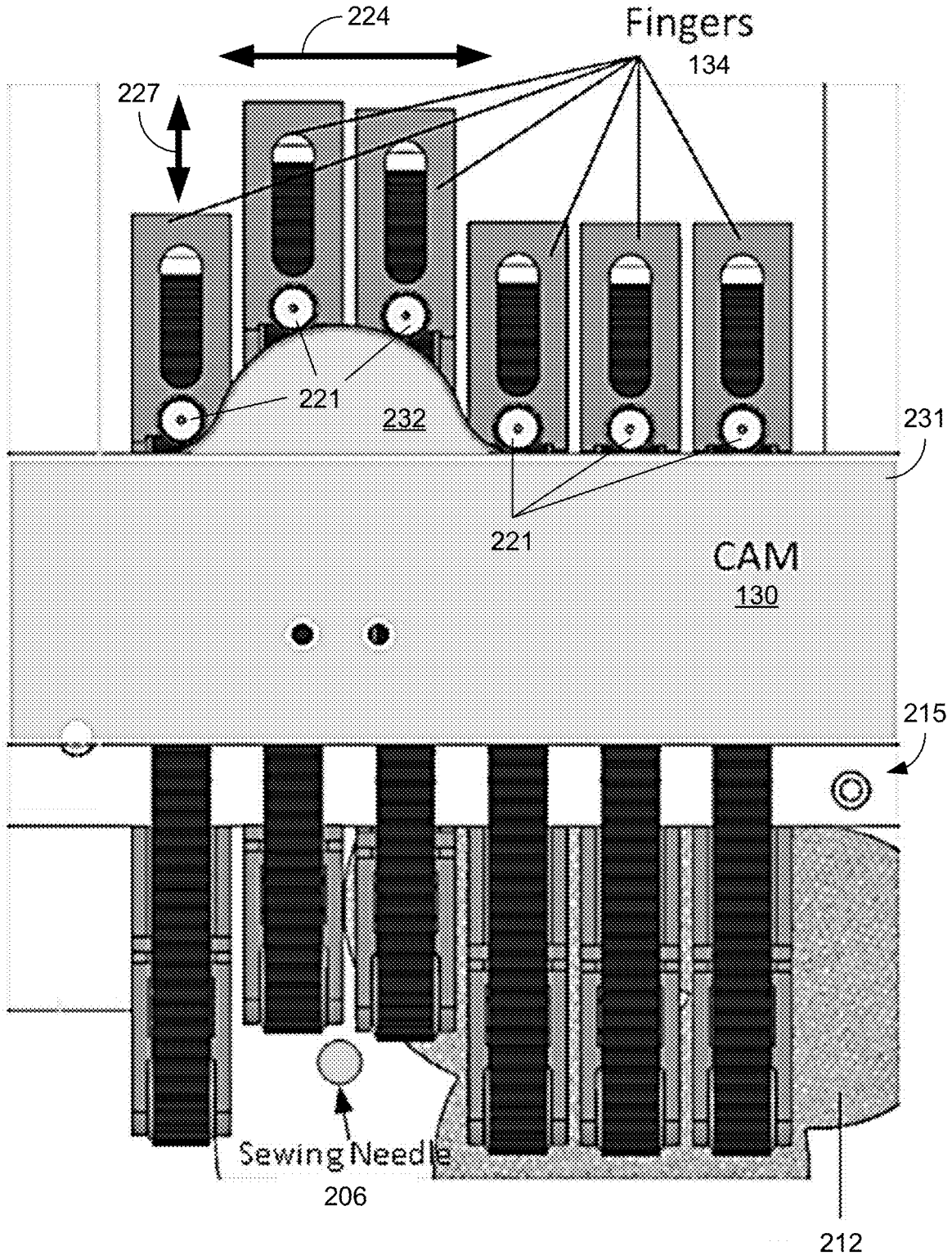

The relationship of the mechanical fingers 134 with respect to the cam profile 130, the location of the sewing needle 206, and the material 212 is further illustrated in the top (or overhead) view of FIG. 2D. As the mechanical fingers 134 are repositioned, the follower 221 moves across the cam profile 130 (as illustrated by arrow 224). The linear array of mechanical fingers 134 can independently translate (as illustrated by arrow 227) onto and off the layered unsewn material pieces 212 without altering their relative position and orientation. The linear array of mechanical fingers 134 can also transport the layers of material 212 on the planar surface of the sewing plane 209 without altering their relative position and orientation. This can be achieved using a belt grounding mechanism that is rigidly connected with the mechanical finger belt and the translation system 128 via metal bracket 215. This connection allows the mechanical finger 134 to translate onto and off of the material 212 based on the cam profile 130.

The mechanical fingers 134 can utilize a belt 218 with a high coefficient of a friction in combination with a low friction worksurface or sewing plane 209 (e.g., a belt with a coefficient of friction about twice (or more) than the coefficient of friction of the sewing plane 209). This combination aids the material holding apparatus 132 to transport layered materials 212 on the planar surface of the sewing plane 209 without altering the materials relative position and orientation. The interaction of the followers 221 with the cam profile 130 causes the mechanical fingers 134 to displace linearly in order to provide the necessary clearance around the sewing needle to sew stitches in the materials 212. This passive system utilizes the cam-follower system to individually displace the fingers linearly to create the clearance around the sewing needle. In some embodiments, this movement can be achieved using motors in each mechanical finger 134 to produce independent linear displacement of each mechanical finger 134.

Figure 2E:
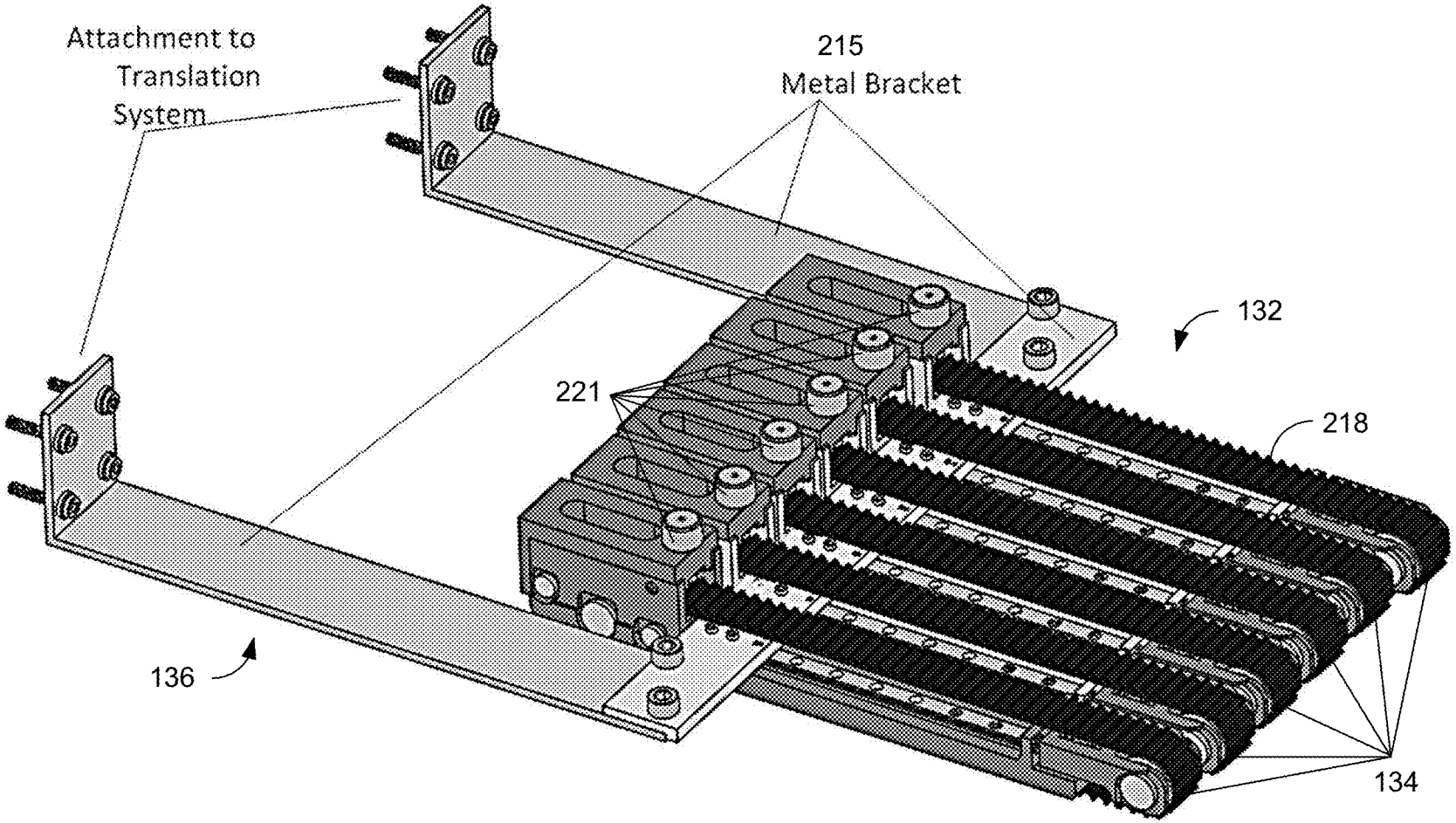

Referring next to FIG. 2E, shown is an array of six mechanical fingers 134 supported by a structural grounding system 136. The mechanical fingers 134 are supported by the metal brackets 215 of the structural grounding system 136, which are configured to attach to the translation system 128. The mechanical fingers 134 utilize a compliant belt 218 made of material that can compress to come into contact with multiple layers of material 212 to improve gripping performance for transporting the layered material 212 on a planar surface of the sewing plane 209 (see, e.g., FIG. 2A). The belt 218 can include ridges or can be textured to improve compliance and contact with the material 212.

Figure 2F:
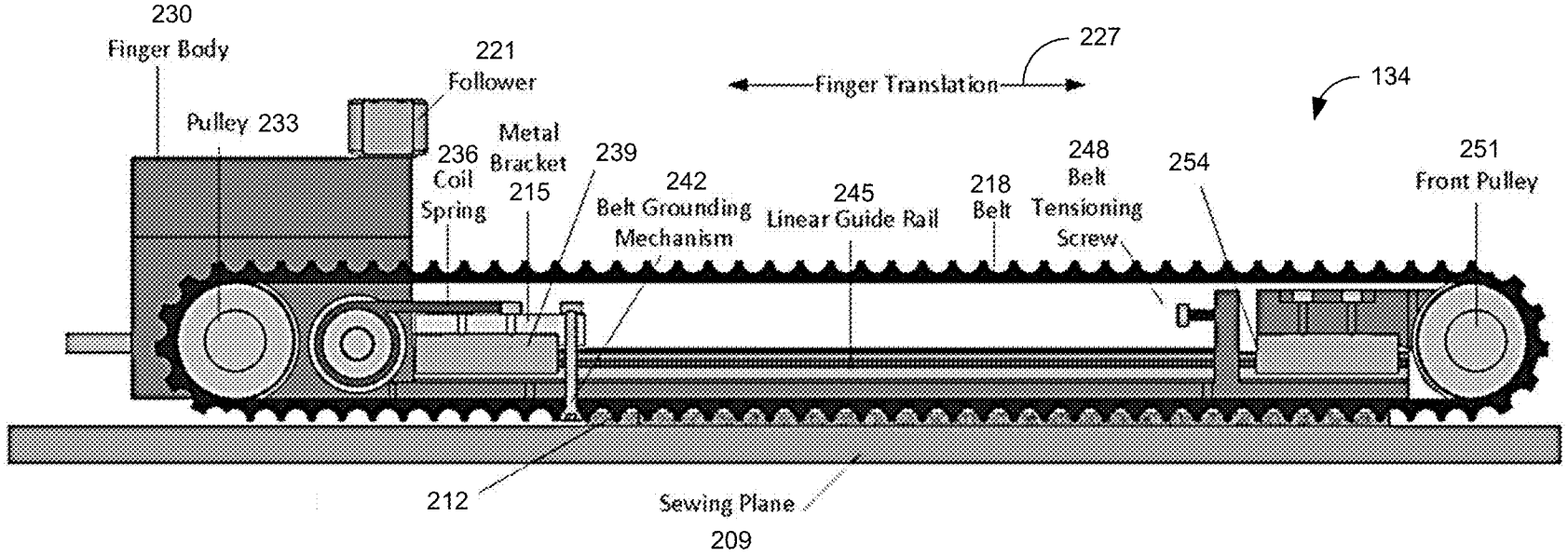
Figure 2G:
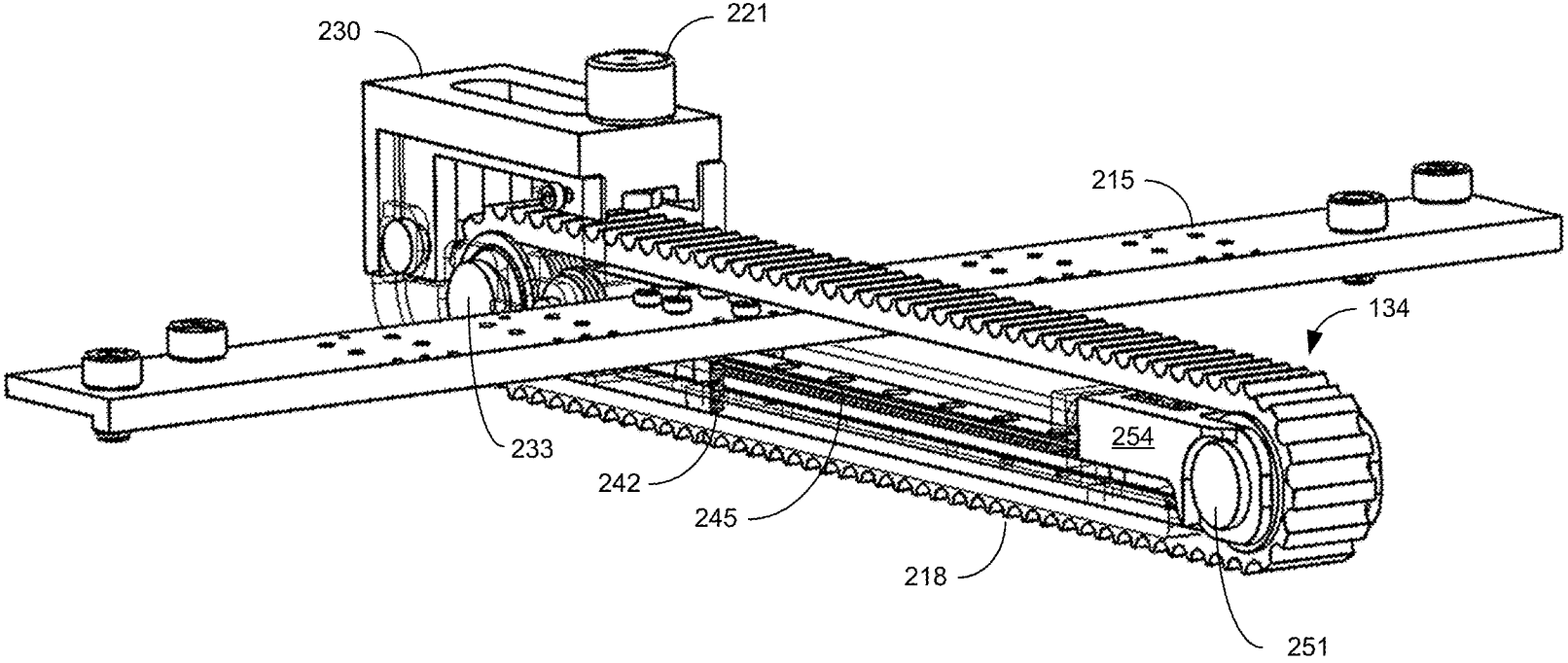
Figure 5A:
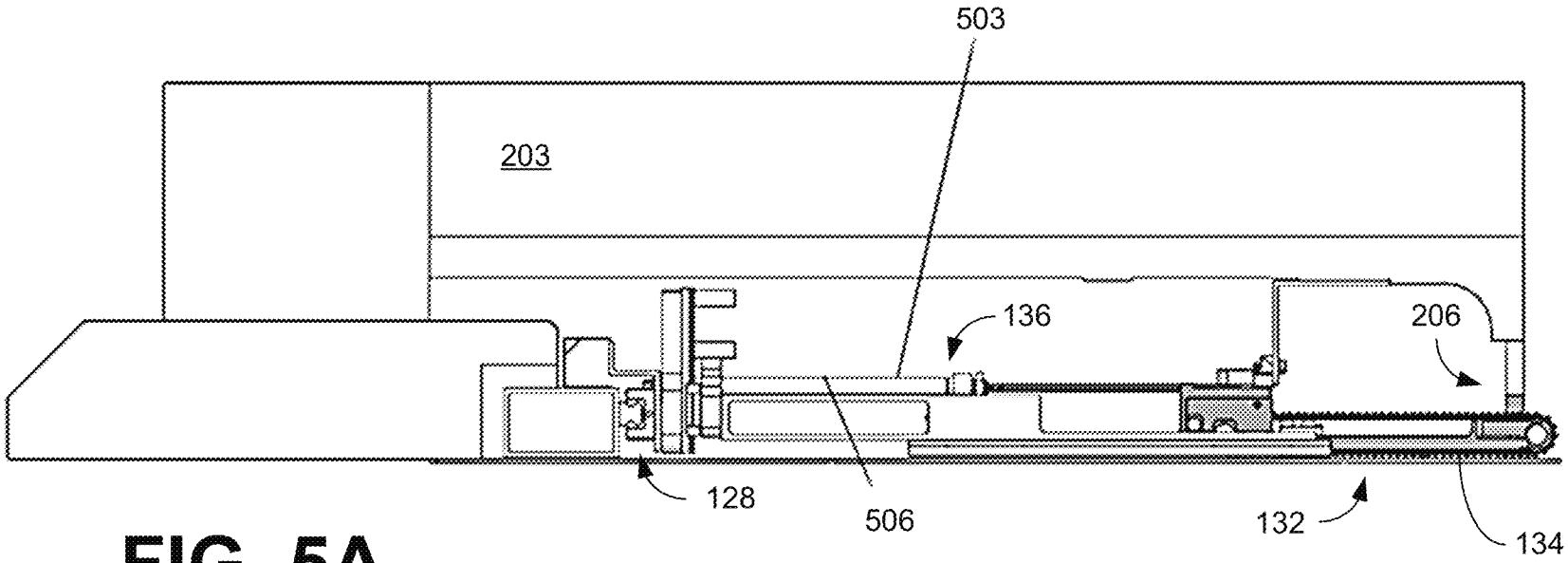
FIGS. 5A and 5B illustrate an example of a structural grounding system comprising air cylinders, according to various embodiments of the present disclosure.
Figure 5B:
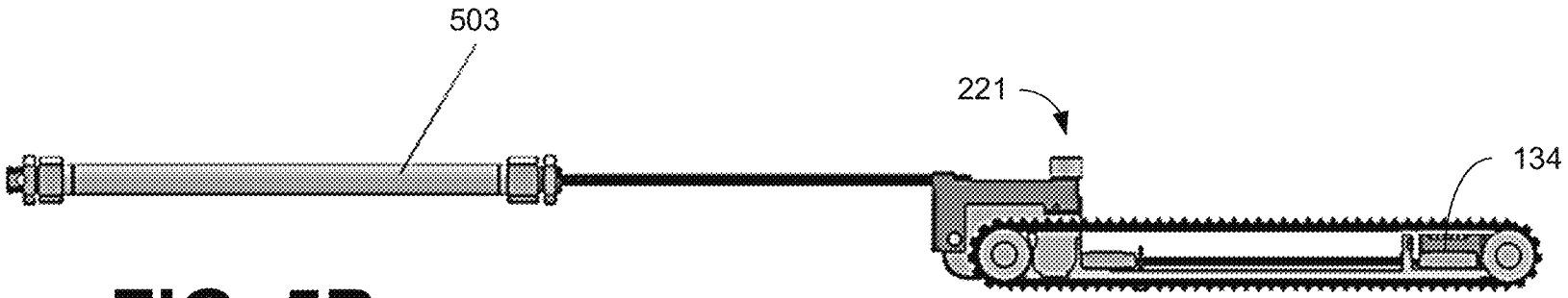

Additional details are illustrated in FIGS. 2F and 2G, which displays a cross section of the mechanical fingers 134. A mechanical finger 134 can comprise a finger body 230, a rear pulley 233, follower 221, coil spring 236, transport carriage 239, belt grounding mechanism 242, linear guide rail 245, belt tensioning screw 248, front pulley 251 and a belt 218 extending between the rear and front pulleys 233 and 251. While a coil spring 236 is illustrated in this example, other appropriate positioning or tensioning devices (e.g., a piston or cylinder as illustrated in FIGS. 5A and 5B) can be utilized. The belt 218 is shown extending across the layered materials 212 on the sewing plane 209. The mechanical fingers 134 can secure the layered materials 212 in a specific position or orientation so that the layered materials 212 can be sewn together.

The finger body 230 is the structure of the mechanical finger 134 supporting the rear pulley 233 and front pulley 251 that allow the belt 218 to stay in contact with the layered materials 212 without altering the orientation or position of the layered materials 212. The rear pulley 233 can be mounted to the finger body 230 and the front pulley 251 can be mounted to a pulley carriage 254 located at a distal end of the mechanical finger 134. The pulley carriage 254 can be mounted to the finger body 230 in a fixed position or can be configured to movably engage with the linear guide rail 245. For example, the linear guide rail 245 can include two rails on opposite sides of a slot or linear opening, which can extend along at least a portion of the axial length of the finger body 230 as illustrated in FIG. 2F. A belt tensioning screw (or bolt) 248 can apply pressure to the pulley carriage 254 to tension the belt 218 looped over the rear and front pulleys 233 and 251. In other embodiments, a belt tensioning screw (or bolt) can tension the belt 218 via the rear pulley 233.

A transport carriage 239 can be attached to a bracket 215 of the structural grounding system 136 that extends across the finger body 230 and rigidly connects to the belt 218. The transport carriage 239 can be configured to movably engage with the linear guide rail 245 to support the mechanical finger 134 during operation. The follower 221 allows the finger body 230 to move out of the way of the sewing needle 206 based upon the design of the cam profile 130. A coil spring 236 (or other appropriate tensioning device such as, e.g., a spring, elastic band or piston) can be attached to the finger body 230 and the bracket 215 of the structural grounding system 136. The coil spring 236 or other tensioning device provides tension to maintain the follower 221 against the surface of the cam profile 130 as shown in FIG. 2D. The tension provided by the coil spring 236 allows the mechanical finger 134 to return to the extended position after passing over the projecting portion of the cam profile 130. Other mechanisms can also be used. For example, a captive cam can be used to return the mechanical finger 134 to the extended position.

The translation 227 of the mechanical finger 134 without altering material layer position and orientation is possible using the passive belt system, which can rotate about the pulleys 233 and 251 as the finger body 230 moves. The belt 218 can be toothed or flat and can be endless or of discrete length. The mechanical fingers 134 utilize a compliant belt material that can compress to contact with multiple layers of material 212 to improve gripping performance for transporting the layered material on the planar surface of the sewing plane 209. In some embodiments, the belt 218 may be replaced with another type of contact element enabling continuous rotation around two rotational axes such as, but not limited to, a chain, material strip, rubber strip, or timing belt.

The linear array of mechanical fingers 134 can act to transport layers of material 212 on the planar surface without altering their relative position and orientation to each other. This can be achieved by utilizing the belt grounding mechanism 242 of the mechanical finger 134 to enable the automated sewing machine 122 XY translation. The belt grounding mechanism 242 comprises a securing element or member that engages with a lower section of the belt 218 to secure it in a stationary or substantially stationary position with respect to the structural grounding system 136. In some implementations, the securing element or member can be a fastener (e.g., a screw, bolt, rivet, or other appropriate fastener) that extends through the belt 218 and is attached to the bracket 215 of the structural grounding system 136 as illustrated in FIG. 2G. For example, the belt grounding mechanism 242 can be a screw that passes through an opening (e.g., a hole) in the belt 218 and the slot or linear opening in the finger body 230 and is affixed to the bracket 215 via a threaded opening or nut. In other implementations, the securing element or member can comprise a block or band that is adhered to or clamped to the lower section of the belt 218 and attached to the structural grounding system 136. In some embodiments, the securing element or member can be embedded into the belt 218 (e.g., molded into the belt by the manufacturer) and configured for attachment to the structural grounding system 136. By fixing the position of the belt 218 with respect to the bracket 215 of the structural support system 132, bunching and wrinkling of the material 212 during movement of the mechanical fingers 134 can be avoided. As a mechanical finger 134 is linearly displaced by the cam profile 130, contact with the material(s) 212 remains the same because of the fixed relationship with the structural grounding system 132. The belt grounding mechanism 242 is free to move within the slot or linear opening extending along the length of the finger body 230. By holding the belts 218 of the mechanical fingers 134 in position, the translation system 128 can transport the materials 212 on the sewing plane 209. The contact points of the belt 218 remain fixed on the layered materials 212 during sewing. The belt grounding mechanism 242 can also prevent the buildup of static charge during operation of the automated sewing machine 122.

Functioning of the structural grounding system 136 and cam profile 130 will now be discussed with reference to FIGS. 3A-3C. One skilled in the art will appreciate that, for this and other processes and methods disclosed herein, the functions performed in the processes and methods may be implemented in differing order. Furthermore, the outlined operations are only provided as examples, and some of the operations may be optional, combined into fewer operations, or expanded to include additional operations without detracting from the essence of the disclosed embodiments.

Figure 3A:
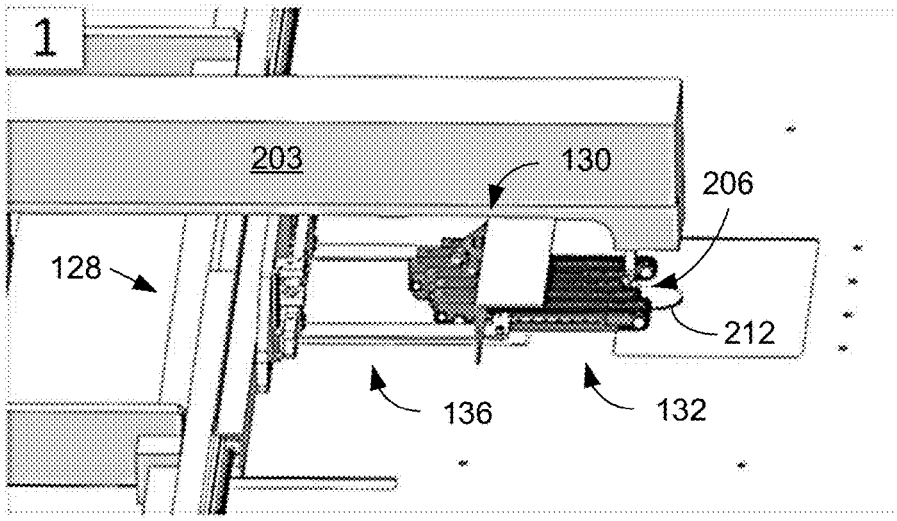
FIGS. 3A-3C illustrate another example of movement of mechanical fingers on a structural grounding system of the material holding apparatus, according to various embodiments of the present disclosure.

Beginning with FIG. 3A, the structural grounding system 136 is in an initial position with the material holding apparatus 132 shown positioned with the mechanical fingers 134 on the layered material 212 as illustrated in FIG. 2F. The mechanical fingers 134 extend around the sewing needle 206 of the sewing machine 203 based upon the interaction of the followers 221 with the cam profile 130. As the translation system 128 is repositioned during the sewing process from an initial position in FIG. 3A to a second position in FIG. 3B, the structural grounding system 136 is extended to move the layered material 212 forward under the sewing needle 206. As can be seen by comparing FIGS. 3A and 3B, the layered material 212 extend further out from the sewing needle 206 but the positions of the mechanical fingers 134 (FIGS. 2A-2F) remain the same because of the fixed position of the cam profile 130 with respect to the sewing needle 206. During the translation of the mechanical fingers 134, the belt 218 (FIGS. 2A-2F) is always in contact with the layered material 212 and therefore preserves their relative position and orientation. This motion of the structural grounding system 136 exposes the layered material 212 to the sewing needle 206. As shown in FIG. 3C, further movement of the structural grounding system 136 by the translation system 128 continues to extend the layered material 212 under the sewing needle 206, while the position of the mechanical fingers 134 do not change. After a seam is made in the layered material 212, the mechanical fingers 134 can translate back onto the layered material as shown in FIG. 3A. The layered material 212 can also be repositioned under the sewing needle 206 using the translation system 128.

Figure 3B:
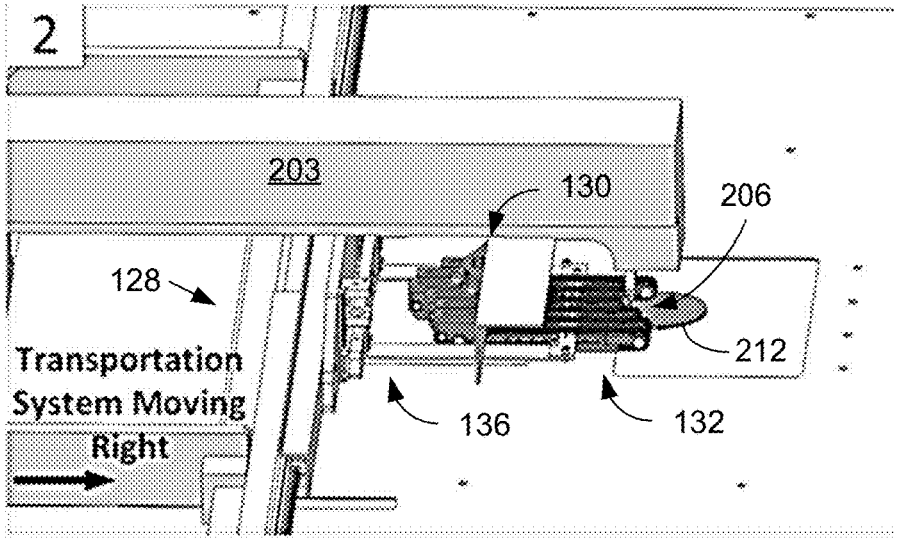
Figure 3C:
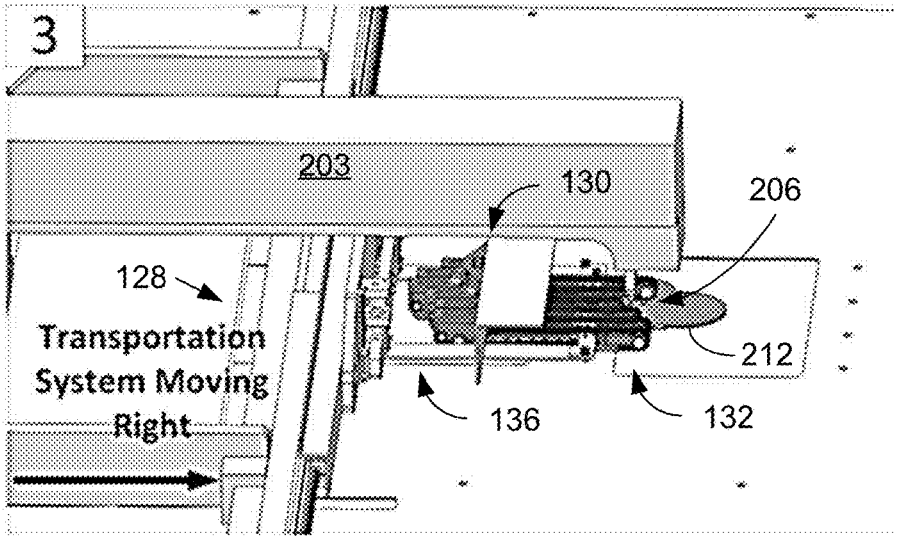
Figure 3D:
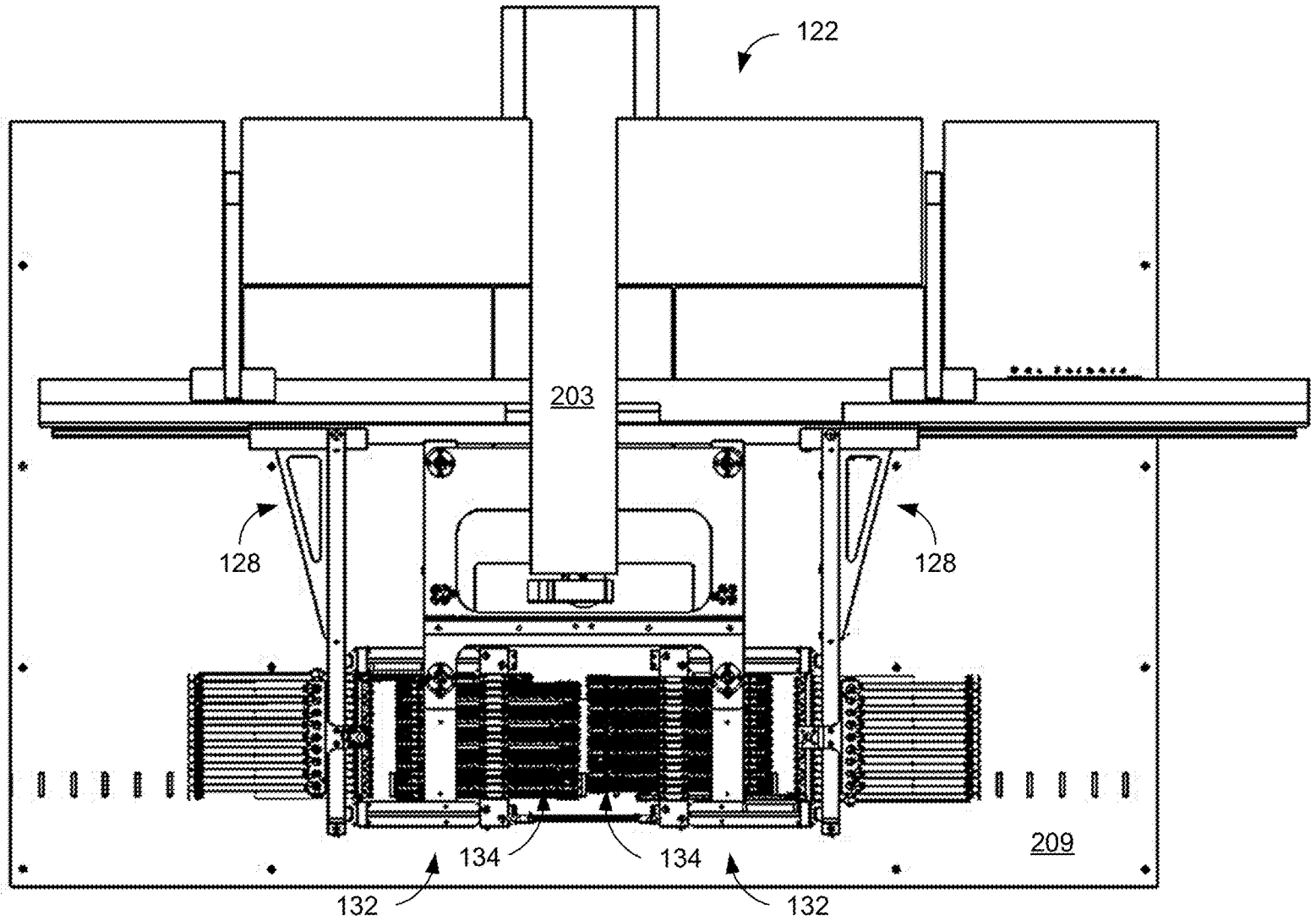
FIGS. 3D and 3E illustrate an example of the translational system and material holding apparatus utilizing multiple arrays of mechanical fingers, according to various embodiments of the present disclosure.
Figure 3E:
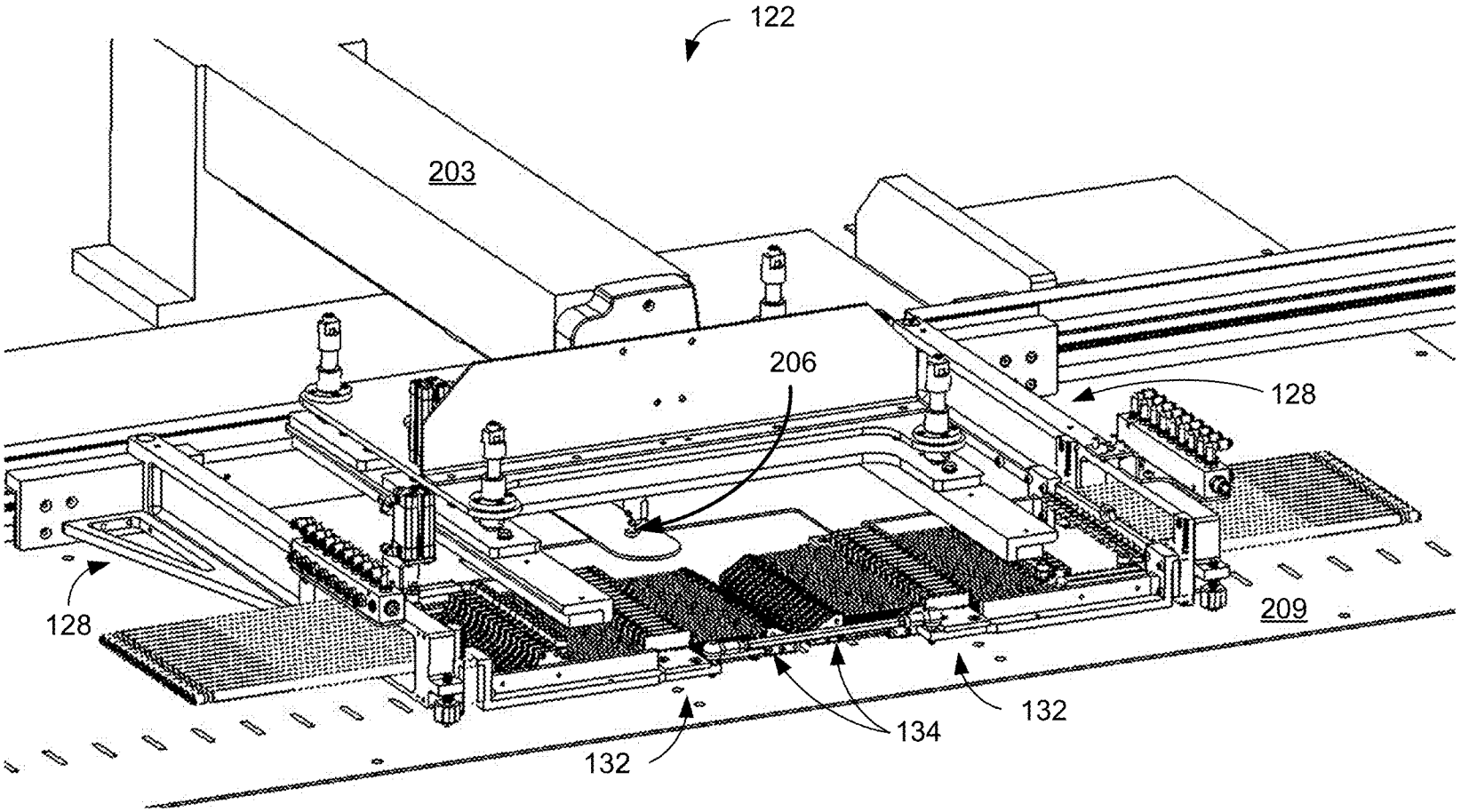

While material(s) 212 can be sewn on the sewing plane 209 utilizing a single array of mechanical fingers 134 of the material holding apparatus 132 as illustrated in FIGS. 3A-3C, multiple arrays of mechanical fingers 134 can also be used to hold the material(s) during sewing. For example, as shown in FIGS. 3D and 3E the material holding apparatus 132 can comprise two arrays of mechanical fingers 134 positioned, e.g., on opposite sides of the sewing needle 206 to facilitate sewing of the material pieces 212. The transportation system 128 can be configured to independently position the arrays of mechanical fingers 134 to contact the material(s) 212. The mechanical fingers 134 of each array can linearly translate away from the sewing needle 206 to provide the needed clearance using a corresponding cam profile 130. The use of multiple arrays of mechanical fingers 134 can assist in the handling of larger pieces of material 212 or better supporting less rigid materials. By contacting the material 212 on two or more sides of the sewing needle 206, the material can be securely held in position during sewing.

FIGS. 3D and 3E provide top and perspective views of the automated sewing machine 122 comprising material holding apparatus 132 with the two arrays of mechanical fingers 134 extended beyond the sewing needle 206 at the sewing head of the sewing machine 203. The automated sewing machine 122 includes a translation system 128 that allows the material holding apparatus 132 to move in an XY motion. The linear array of mechanical fingers 134 acts as a means of transporting layers of material on a planar surface of the sewing plane 209 without altering their relative position and orientation. With the material holding apparatus 132 positioned with the two arrays of mechanical fingers 134 on the material, the translation system 128 can move the material under the sewing needle 206 via the material holding apparatus 132. As the arrays of mechanical fingers 134 are advanced toward the sewing needle 206, individual mechanical fingers 134 on opposite sides of the sewing needle 206 are retracted to provide clearance around the sewing needle 206 as it sews the material. For example, each array of material fingers 134 can use a cam profile 130 to retract material fingers 134 in the vicinity of the sewing needle 206 as previously disclosed. In other implementations, individual position control (e.g., pneumatic piston or cylinder, linear motor, etc.) can be used to reposition individual material fingers 134 as will be discussed.

Figure 4A:
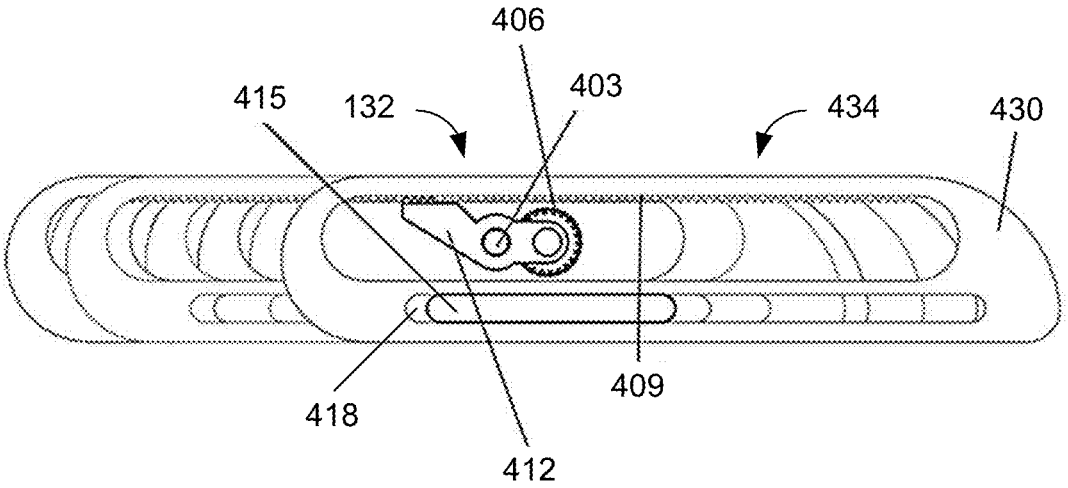
FIGS. 4A and 4B illustrate an example of a material holding apparatus comprising a central drive shaft, according to various embodiments of the present disclosure.
Figure 4B:
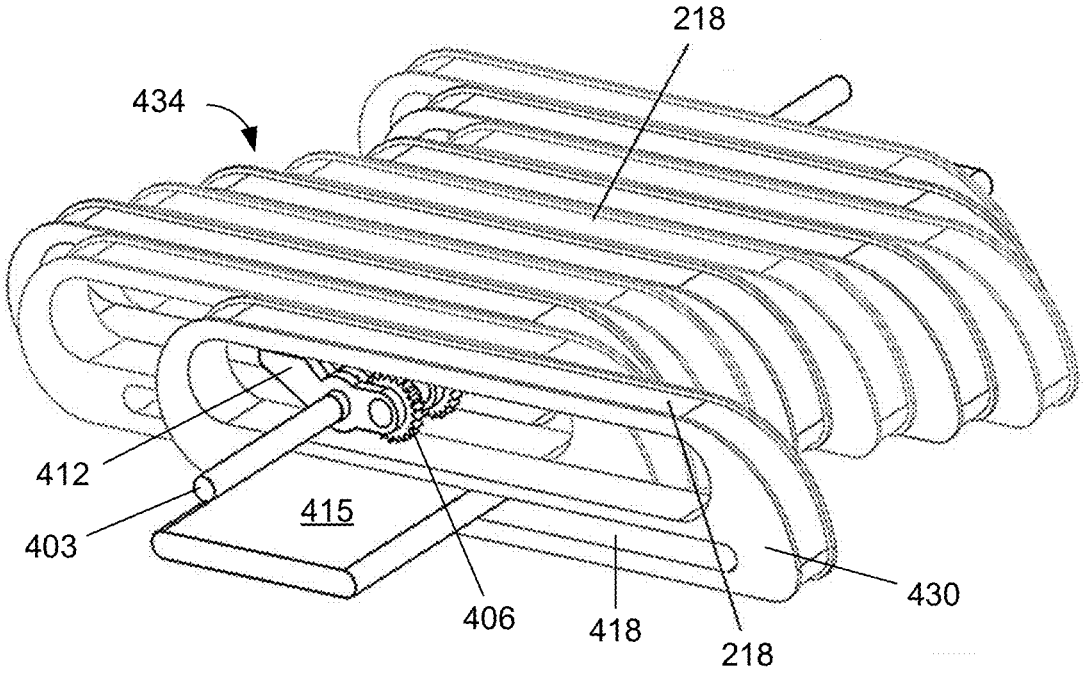

Referring next to FIGS. 4A and 4B, shown are side and perspective views of another embodiment of mechanical fingers 434 of a material holding apparatus 132 comprising a central drive shaft 403. The mechanical fingers 434 can be driven by the central drive shaft 403 and can include a mechanism to hold that mechanical finger 434 in position. As shown in the example of FIG. 4A, the material holding apparatus 132 can comprise a guide 415, the central drive shaft 403, a gear 406, the mechanical fingers 434, a gear rack 409, and a rocker paw 412. As previously discussed, the mechanical fingers 434 can secure the layered materials 212 in a specific position or orientation so that the layered materials 212 can be sewn together. A guide 415 (e.g., a metal bracket) is passed through a guide slot 418 in all the mechanical fingers 434. A gear 406 can be driven off the central drive shaft 403. The central drive shaft 403 passes through the mechanical fingers 434 and can be used to drive the gear 406 on each individual mechanical finger 434.

The finger body 430 provides the structure for a passive belt system of the mechanical finger 434, around which a belt 218 or other contact element such as e.g., a chain, material strip, rubber strip, timing belt, etc. can rotate, allowing the translation of a mechanical finger 434 without altering the position and orientation of the layered materials 212. The belt 218 can be toothed or flat and can be endless or of discrete length. The mechanical fingers 434 can utilize a compliant belt material that can compress to contact with multiple layers of material 212 to improve gripping performance for transporting the layered material 212 on a planar surface of the sewing plane 209.

The linear array of mechanical fingers 434 shown in FIG. 4B can act as a means of transporting layers of material 212 on the planar surface of the sewing plane 209 without altering their relative position and orientation. This can be achieved by utilizing a belt grounding mechanism (e.g., 242 of FIG. 2F) of the mechanical finger 434 to enable the automated sewing machine 122 XY translation. The belt grounding mechanism can also prevent the buildup of static charge during operation of the automated sewing machine 122.

Each mechanical finger 434 has a gear rack 409 that allows the gear 406 to engage with the mechanical finger 434 and driven by the central drive shaft 403 that passes through each mechanical finger 434. Each mechanical finger 434 can comprise a rocker paw 412 to either allow the position of the mechanical finger 434 to be locked in place by engaging teeth on a locking arm of the rocker paw 412 with the gear rack 409 as illustrated in FIG. 4A or to rock forward (or rotate upward) allowing the gear 406 to engage with the gear rack 409 of the mechanical finger 434. Rotation of the rocker paw 412 can disengage the teeth on the locking arm from the gear rack 409 and engage the gear 406 with the central drive shaft 403 and the gear rack 409.

Instead of the passive cam-follower system shown in FIGS. 2A-2F, the embodiment shown in FIGS. 4A and 4B provides an active system using the central drive shaft 403 and rocker paw 412 to adjust position of the mechanical fingers 434. Translation of the mechanical fingers 434 can be independently controlled using the rocker paw 412 of a mechanical finger 434 to engage or disengage the gear 406 with the gear rack 406 and central drive shaft 403 to move that mechanical finger 434 to provide clearance around the sewing needle 206 for stitching the layered materials 212. As illustrated in FIG. 4B, the position of the mechanical fingers 434 can be independently controlled by the robotic system 102.

Referring now to FIGS. 5A and 5B, shown is another embodiment of a structural grounding system 136 to control linear positioning of the mechanical fingers 134 of the material holding apparatus 132. For example, if the mechanical fingers 134 have individual position control (e.g., pneumatic piston or cylinder, linear motor, etc.) then their positions can be individually controlled as the structural grounding system 136 translates the material 212 during sewing. Control of the individual finger positions can be provided by, e.g., closed-loop electrical or pneumatic control systems. In this embodiment, translation of the mechanical fingers 134 can be accomplished with or without a cam profile 130.

As illustrated in the embodiment of FIG. 5A, the structural grounding system 136 can comprise a piston or cylinder system attached to the translation system 128 in order to provide the linear translations for each of the individual mechanical fingers 134. Each mechanical finger 134 can be controlled individually by a corresponding piston or cylinder 503. In some embodiments, the piston or cylinder system can use servo-pneumatic air cylinders with proportional air valves to control the positions of each of the individual mechanical fingers 134. An air cylinder can be a mechanical device which uses the power of a compressed gas to produce a force in a reciprocating linear motion. In various embodiments, the cylinder may be a pneumatic cylinder which utilizes a gas in order to move the piston of the cylinder in the desired direction. In other embodiments, an electromechanical device 506 can be used to produce the linear translation.

FIG. 5B illustrates an example of a single pneumatic cylinder 503 of an air cylinder system. The air cylinder 503 is connected to the finger body of an individual mechanical finger 134 and controls the linear movement of the mechanical finger 134. In some embodiments, the air cylinder 503 can be a servo-pneumatic air cylinder with proportional air valves to control the positions of each of the individual mechanical fingers 134. The air cylinder 503 can control the translation of the mechanical finger 134 by the application or release of a compressed gas to produce the linear motion. Where a cam profile 130 is used, the air cylinder 503 (instead of the coil spring 236 of FIG. 2F) can maintain pressure on the finger body to ensure contact of the follower 221 with the surface of the cam profile 130. In some embodiments, the piston or cylinder system can comprise a rotary motor with linear drive train mechanism, linear motors, magnets, electromagnets, that can be used to create the linear displacement of the mechanical fingers. FIGS. 3D and 3E show an example of arrays of mechanical fingers 134 utilizing the piston or cylinder system.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A system for transporting and sewing material, comprising:

a sewing machine including a sewing needle;

a material holding assembly comprising:

mechanical fingers configured to contact material on a sewing plane adjacent to the sewing needle, the mechanical fingers configured to secure a relative orientation and position of the material during sewing of the material, wherein each of the mechanical fingers comprises a passive belt system that contacts the material to secure the orientation and position; and a structural grounding system supporting the mechanical fingers, where clearance around the sewing needle is provided by repositioning individual mechanical fingers around the sewing needle; and a translation system attached to the structural grounding system, the translation system configured to transport the material on the sewing plane via the mechanical fingers.

2. The system of claim 1, wherein the passive belt system comprises a belt extending between a pair of pulleys attached to the mechanical finger, wherein the belt passively rotates about the pair of pulleys during linear translation of the mechanical finger.

3. The system of claim 2, wherein the pair of pulleys comprises a first pulley attached at a first fixed position and a second pulley attached at a second adjustable position.

4. The system of claim 2, wherein a lower section of the belt is secured in a fixed position with respect to the structural grounding system by a belt grounding mechanism of the structural grounding system.

5. The system of claim 4, wherein the belt grounding mechanism comprises a securing element coupled to a bracket of the structural grounding system and engaged with the lower section of the belt.

6. The system of claim 1, wherein the structural grounding system comprises a bracket extending through the mechanical fingers.

7. The system of claim 6, wherein each of the mechanical fingers comprises a tensioning device attached to the mechanical finger and the bracket.

8. The system of claim 7, wherein the tensioning device is a coil spring.

9. The system of claim 6, wherein the structural grounding system comprises a cylinder system including cylinders attached to each of the mechanical fingers.

10. The system of claim 9, wherein the cylinders are pneumatic cylinders.

11. A system for transporting and sewing material, comprising:

a sewing machine including a sewing needle;

a material holding assembly comprising:

mechanical fingers configured to contact material on a sewing plane adjacent to the sewing needle, the mechanical fingers configured to secure a relative orientation and position of the material during sewing of the material; and a structural grounding system supporting the mechanical fingers, where clearance around the sewing needle is provided by repositioning individual mechanical fingers around the sewing needle;

a translation system attached to the structural grounding system, the translation system configured to transport the material on the sewing plane via the mechanical fingers; and a cam profile attached to the sewing machine, the cam profile positioned to engage with followers of the mechanical fingers.

12. The system of claim 11, wherein a tensioning device attached to the mechanical finger maintains contact of the follower with a surface of the cam profile.

13. The system of claim 12, wherein the surface of the cam profile comprises a projecting portion, where the mechanical fingers linearly translate away from the sewing needle in response to engagement with the projection portion.

14. The system of claim 12, wherein the followers of the mechanical fingers move across the surface of the cam profile in response to repositioning of the structural grounding system and mechanical fingers by the translation system.

15. A system for transporting and sewing material, comprising:

a sewing machine including a sewing needle;

a material holding assembly comprising:

mechanical fingers configured to contact material on a sewing plane adjacent to the sewing needle, the mechanical fingers configured to secure a relative orientation and position of the material during sewing of the material;

a structural grounding system supporting the mechanical fingers, where clearance around the sewing needle is provided by repositioning individual mechanical fingers around the sewing needle; and a central drive shaft extending through the mechanical fingers, where the mechanical fingers are configured to individually translate their position via the central drive shaft; and a translation system attached to the structural grounding system, the translation system configured to transport the material on the sewing plane via the mechanical fingers.

16. The system of claim 15, wherein each of the mechanical fingers comprises a rocker paw configured to engage a gear with a gear rack of the mechanical finger to translate the mechanical finger.

17. The system of claim 16, wherein the rocker paw is further configured to disengage the gear from the gear rack and engage teeth of the rocker paw to secure the mechanical finger in a fixed position.

18. The system of claim 15, wherein the structural grounding system comprises a guide extending through a guide slot of the mechanical fingers.

19. The system of claim 15, wherein each of the mechanical fingers comprises a belt that contacts the material to secure the orientation and position, the belt encircling a finger body of the mechanical finger.

20. The system of claim 1, where the mechanical fingers are configured to individually translate their position via a central drive shaft, pneumatic piston or linear motor.

* * * * *